US009038296B2

(12) United States Patent
Melic

(10) Patent No.: US 9,038,296 B2
(45) Date of Patent: May 26, 2015

(54) LOUVER DISPLAY PANEL SYSTEM FOR MULTI-STORY BUILDING

(71) Applicant: John J. Melic, Stoney Creek (CA)

(72) Inventor: John J. Melic, Stoney Creek (CA)

( * ) Notice: Subject to any disclaimer, the term of this patent is extended or adjusted under 35 U.S.C. 154(b) by 0 days.

(21) Appl. No.: 13/869,337

(22) Filed: Apr. 24, 2013

(65) Prior Publication Data

US 2013/0283656 A1 Oct. 31, 2013

Related U.S. Application Data

(60) Provisional application No. 61/639,331, filed on Apr. 27, 2012.

(51) Int. Cl.
*G09F 7/00* (2006.01)
*G09F 15/00* (2006.01)
*G09F 19/22* (2006.01)

(52) U.S. Cl.
CPC ..... *G09F 15/0087* (2013.01); *G09F 15/0018* (2013.01); *G09F 19/226* (2013.01)

(58) Field of Classification Search
CPC ..... G09F 7/002; G09F 7/22; G09F 1/14; G09F 7/00; E01F 9/012
See application file for complete search history.

(56) References Cited

U.S. PATENT DOCUMENTS

| | | | | | |
|---|---|---|---|---|---|
| 1,750,118 | A | * | 3/1930 | Mueller, Jr. et al. | 40/613 |
| 2,084,818 | A | | 6/1937 | Neil | |
| 3,144,133 | A | * | 8/1964 | Poulos | 211/1.53 |
| 3,635,352 | A | * | 1/1972 | Brooks et al. | 211/47 |
| 3,706,148 | A | * | 12/1972 | Johnston | 40/505 |
| 4,248,001 | A | * | 2/1981 | Feuvray | 40/602 |
| 4,503,631 | A | | 3/1985 | Kelly | |
| 4,593,265 | A | * | 6/1986 | McKenney | 340/908.1 |
| 4,638,580 | A | * | 1/1987 | Giannetti et al. | 40/503 |
| 4,879,965 | A | * | 11/1989 | Valley | 116/209 |
| 4,910,898 | A | | 3/1990 | Hector | |
| 4,912,865 | A | * | 4/1990 | Ellsworth et al. | 40/602 |
| 5,339,765 | A | * | 8/1994 | Ward | 116/63 P |
| 5,692,330 | A | * | 12/1997 | Anderson, Jr. | 40/505 |
| 6,250,039 | B1 | * | 6/2001 | Karten et al. | 52/645 |
| D466,449 | S | * | 12/2002 | Buring et al. | D12/93 |
| 7,277,080 | B2 | * | 10/2007 | Goulthorpe | 345/108 |
| 2006/0254102 | A1 | * | 11/2006 | Mayants | 40/602 |
| 2011/0146121 | A1 | * | 6/2011 | Gatuslao | 40/606.01 |
| 2013/0283656 | A1 | * | 10/2013 | Melic | 40/602 |

FOREIGN PATENT DOCUMENTS

| | | | |
|---|---|---|---|
| CN | 201955998 | U | 8/2011 |
| FR | 2808611 | A1 | 11/2001 |

OTHER PUBLICATIONS

WIPO, International Search Report for PCT/CA2013/000414 (Jul. 26, 2013).

* cited by examiner

*Primary Examiner* — Shin Kim
(74) *Attorney, Agent, or Firm* — Laurence P. Cotton; Smith Risley Tempel Santos LLC

(57) ABSTRACT

A louver display panel system with a display panel for receiving printed or graphic material thereon, a support member to secure the display panel to a building or structure, and a louver movement control means. The display panel is rotationally secured to the support member and forms a louver structure. The louver movement control means maintains the display panel in a first position in a plane generally parallel to the exterior face of the building or structure until a wind load applied to the display panel exceeds a pre-determined value, after which the louver movement control means permits the display panel to rotate toward a second position generally parallel to the direction of the wind to reduce the wind load borne by the display panel. The louver movement control means returns the display panel to its first position when the wind load drops below said pre-determined value.

12 Claims, 16 Drawing Sheets

5
15
14

7
C
4
4

15
11
4
4

LOUVER DISPLAY PANEL SYSTEM FOR MULTI-STORY BUILDING

STATEMENT OF RELATED APPLICATIONS

This application claims the benefit of U.S. Provisional Patent Application No. 61/639,311 having a filing date of 27 Apr. 2012.

BACKGROUND OF THE INVENTION

1. Technical Field

This invention relates to display panels as could typically be used on a multi-story building, and in particular a louver style display panel system.

2. Prior Art

The construction of multi-story residential or commercial buildings presents a developer with a unique ability to sell advertising space or to display the developer's name during the construction phase. The construction of a multi-story building often attracts the attention of the public making it an ideal display or advertising medium. The difficulty that construction companies and developers have traditionally faced is how to easily and economically display advertising from the building without interfering in its construction, and at the same time without presenting a structure that can be easily destroyed or damaged when exposed to high winds. There is also a concern that any form of advertising could be blown off the building causing damage to property or injury to persons below.

One mechanism that has been developed by others in order to present developers with the ability to utilize buildings under construction for purpose of advertising is the use of large fabric or flexible banners that are placed on the exterior of the building. Such banners often have a rigid frame to which they are secured. Typically the banners will have a series of slits (commonly semi-circular in shape) cut into their surface that permit wind to more easily pass through the banners to reduce the load applied to them during high winds or in storm situations. Unfortunately, since the slits are usually cut into relatively flexible material they often open during times of relatively low wind, obscuring portions of the advertising printed on the banner. If subjected to high winds the slits may not be of sufficient size to allow enough air to pass through the banner, which may result in either a ripping of the banner or the banner blowing completely off of the building structure.

Still others have suggested the use of an open mesh fabric for purposes of advertising and display. In order to ensure that a sufficient amount of wind can pass through the banner during periods of high wind, the mesh typically has to be of a significantly open weave. As the weave becomes more open there is less material upon which to print advertising, making the ability for the display of sharp and crisp images rather limited.

There is therefore a need for an improved method of displaying advertising on multi-story buildings, particularly during their construction phase.

BRIEF SUMMARY OF THE INVENTION

The invention therefore provides a new and novel louver display panel system for use on multi-story buildings and other structures.

Accordingly, in one of its aspects the invention provides a louver display panel system comprising one or more display panels for receiving advertising or other printed or graphic material thereon; one or more support members to secure said one or more display panels to a building or structure, said one or more display panels rotationally secured and mounted to said one or more support members and forming a louver structure; at least one louver movement control means, said louver movement control means maintaining said one or more display panels in a first position where they are in a plane generally parallel to the exterior face of the building or structure until a forwardly or rearwardly directed wind load applied to said one or more display panels exceeds a pre-determined value, after which said louver movement control means permits said one or more display panels to at least partially rotate toward a second position that is generally parallel to the direction of the wind to reduce the wind load borne by said one or more display panels, said louver movement control means returning said one or more display panels to said first position when the wind load drops below said pre-determined value.

In a further aspect the invention provides a louver display panel system comprising a generally rectangular display panel rotationally secured and mounted to a pair of support posts that are releasably securable to a building or structure, said display panel forming a louver structure; and a pair of louver movement control means associated with said display panel, each of said control means comprising a pair of pneumatic or hydraulic cylinders mounted end to end with their pistons extending in opposite directions and having one piston secured to one of said support posts and the other of said pistons secured to a bracket secured to said display panel, said pneumatic or hydraulic cylinders maintaining said display panel in a plane that is generally parallel to the exterior face of the building or structure until either a forwardly or rearwardly directed wind load is applied to said panel that exceeds a pre-determined value, after which said pneumatic or hydraulic cylinders permit said display panel to rotate to thereby reduce the wind load borne by said display panel, said pneumatic or hydraulic cylinders returning said display panel to its position where it is generally parallel to the exterior face of the building or structure when said wind load drops below said pre-determined value.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DETAILED DESCRIPTION OF PREFERRED EMBODIMENTS

The present invention may be embodied in a number of different forms. The specification and drawings that follow describe and disclose some of the specific forms of the invention.

Figure 1:
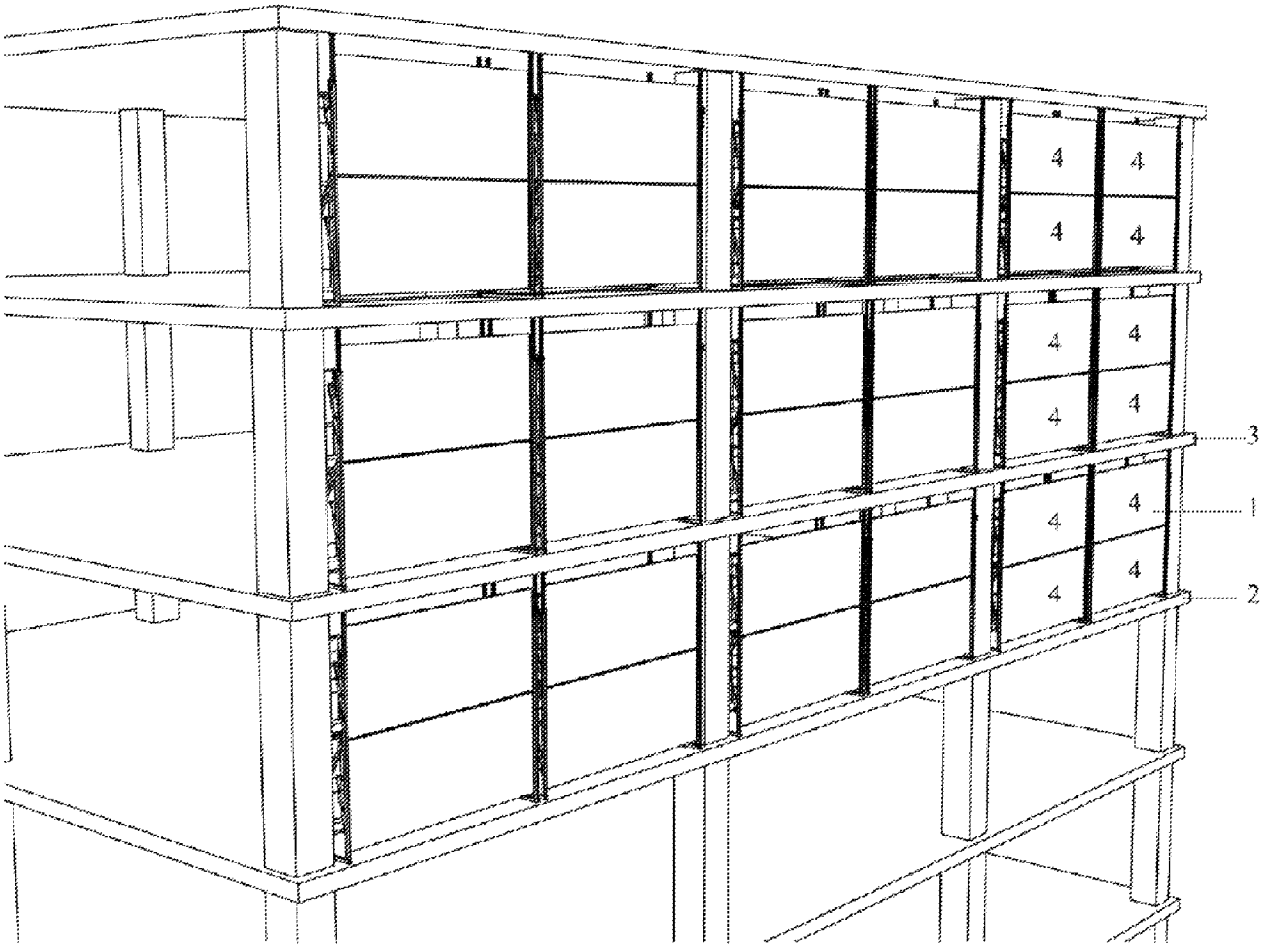
FIG. 1 is a side perspective view of a multi-story building under construction having the louver display panel system in accordance with one of the embodiments of the invention secured thereto.
Figure 2:
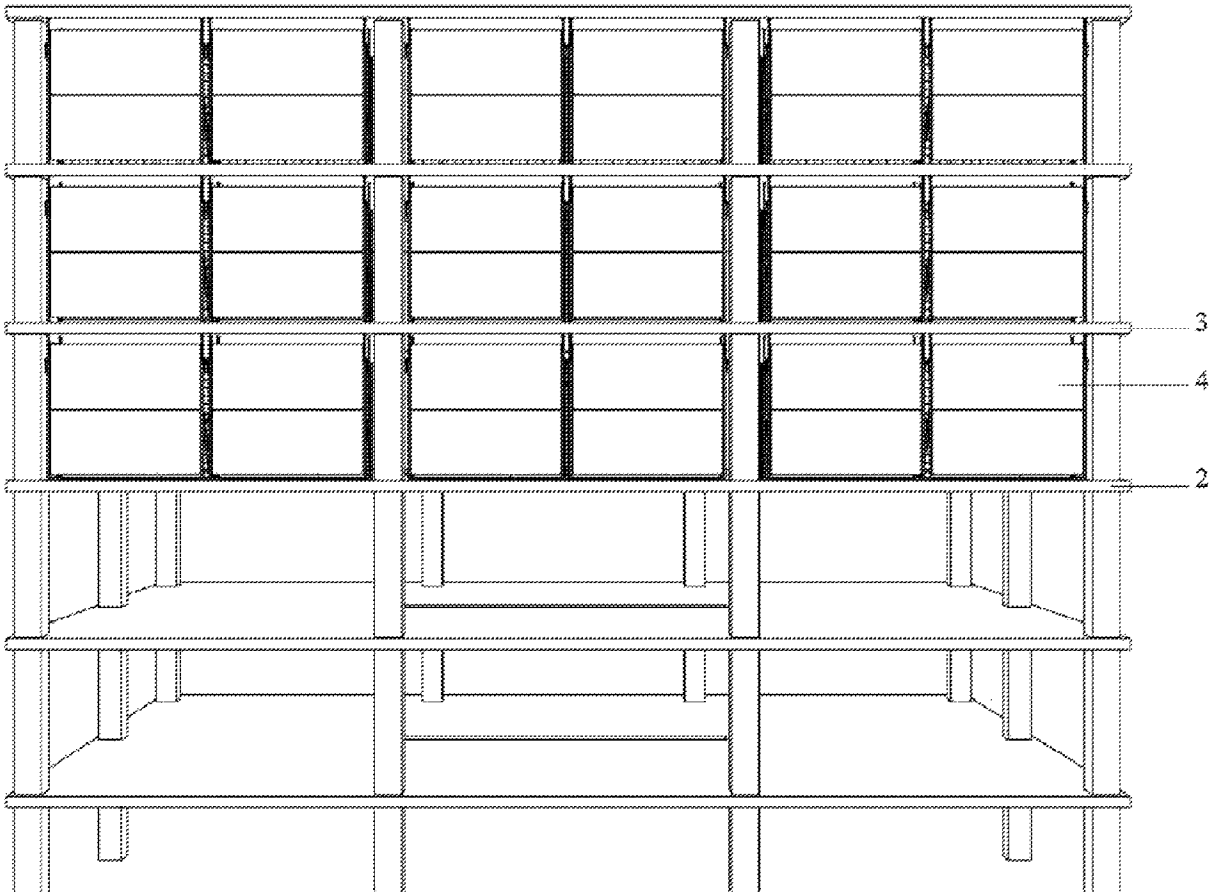
FIG. 2 is a front elevational view of the building shown in FIG. 1.
Figure 3:
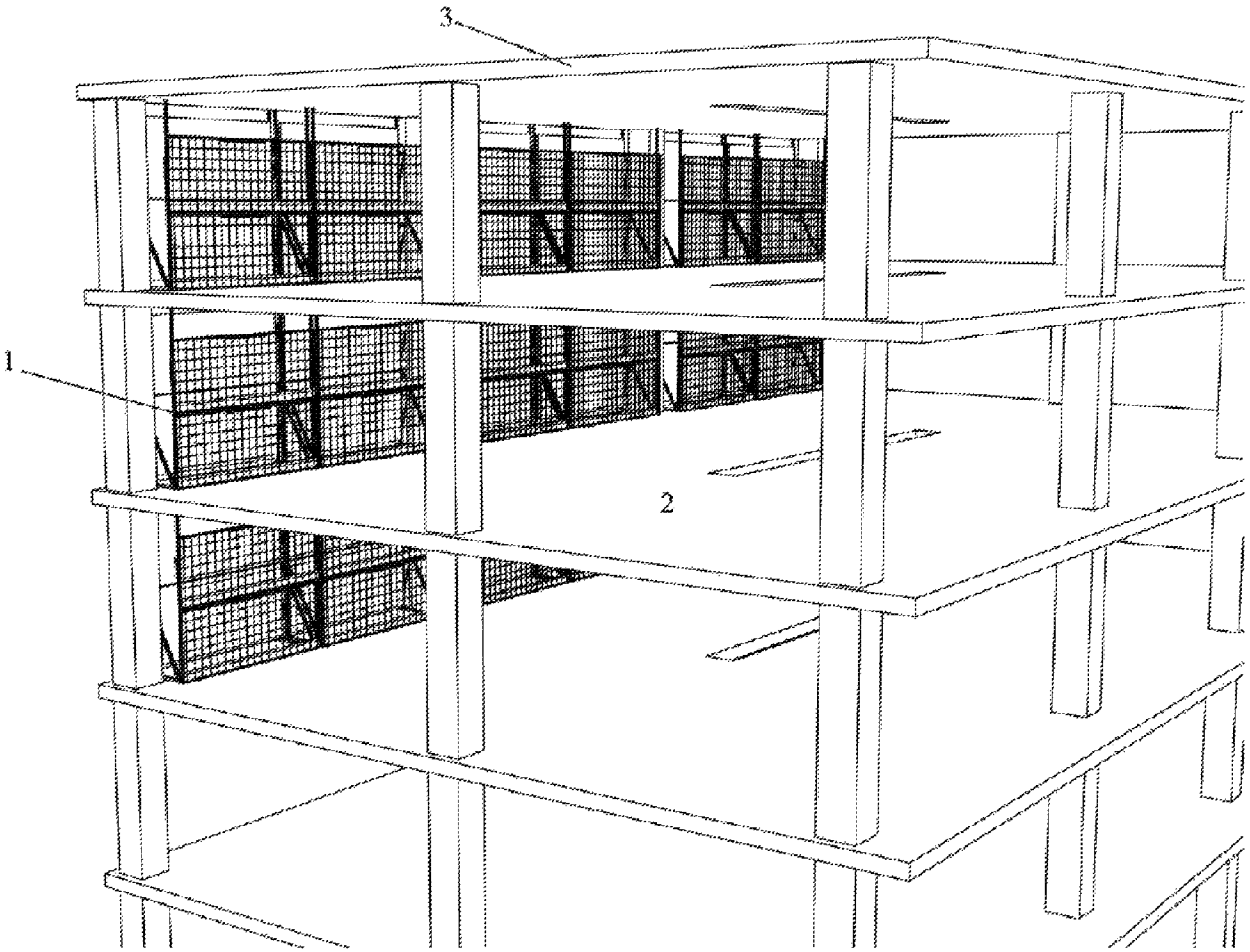
FIG. 3 is a rear side perspective view of the building shown in FIG. 1.
Figure 4:
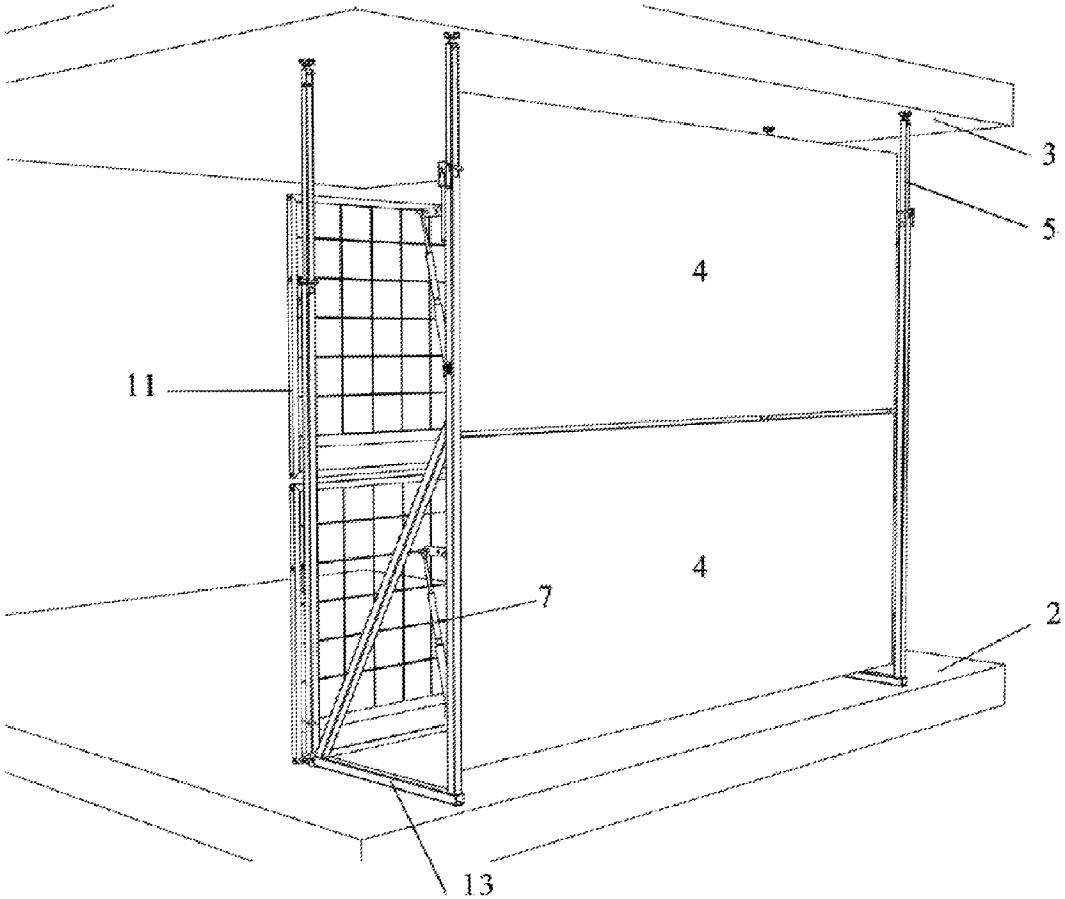
FIG. 4 is a side perspective view of the louver display panel system in accordance with one of the embodiments of the invention shown fixed in place in between two floors of a multi-story building under construction.
Figure 5:
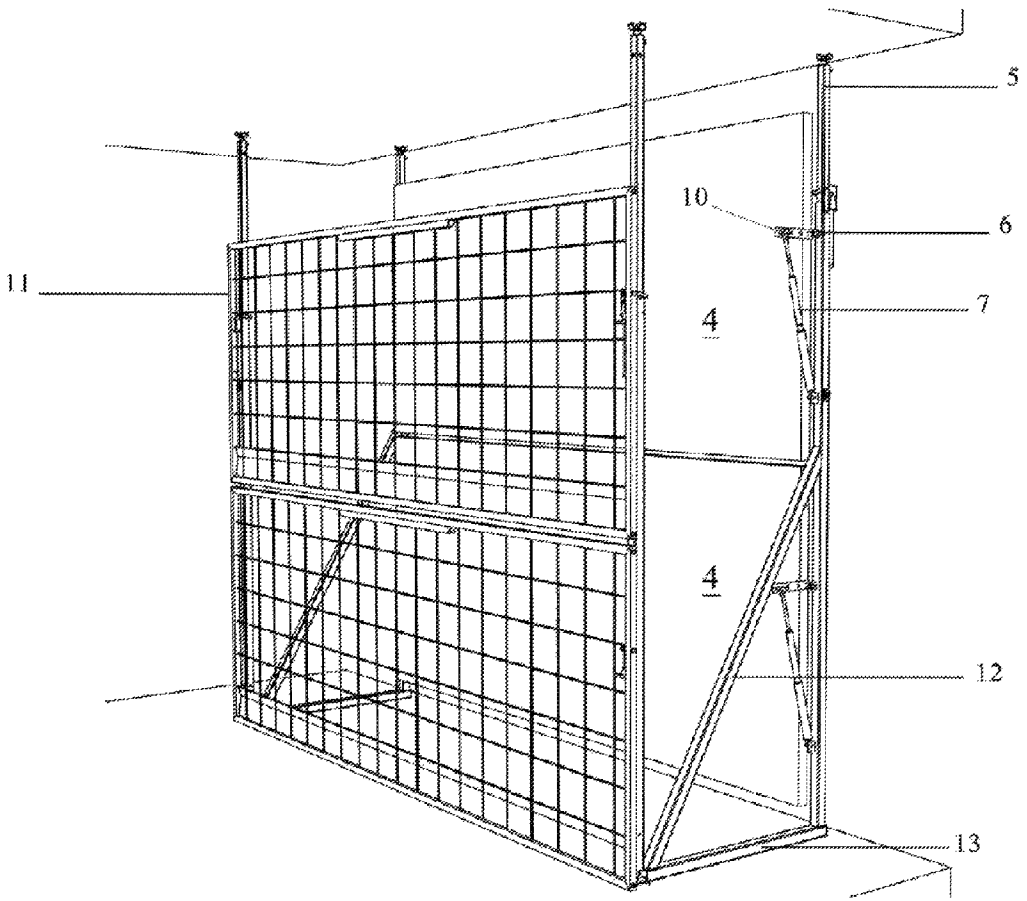
FIG. 5 is a rear view of the louver display panel system shown in FIG. 4.

FIG. 1 shows a side perspective view of a multi-story building under construction having a louver display panel system 1 constructed in accordance with one of the embodiments of the invention. The louver display system is shown as it would typically be mounted between the floor structure 2 and the ceiling structure 3 of individual floors of the building, and before the exterior cladding or glass has been installed. Louver display panel system 1 includes one or more display panels 4 for receiving advertising or other printed or graphic material thereon. In the embodiment of the invention shown in FIG. 1 each individual display panel system includes two such display panels that are generally rectangular in configuration with their longitudinal axes situated horizontally, one panel above the other. Although not specifically shown in the attached figures, the advertising or other printed or graphic material would be applied to the exterior surface of the display panels such that it is viewable from a position outside of the building. It will be appreciated that depending upon the size of the building and the advertising or other material to be displayed, various combinations of rows and columns of display panels could be utilized.

With reference to FIGS. 4 through 12, louver display panel system 1 further includes one or more support members 5 to secure the display panels to a building or structure. In the application shown, the support members are telescopic support posts that are secured between the floor 2 and the ceiling 3 of a multi-story building. A variety of different types of support posts that are commonly used in the assembly of safety barriers during the construction of high-rise buildings could be used, as could rigid and non-extendible support posts or members. There may also be applications where it is desirable to secure louver display panel system 1 to the roof of a building, or perhaps a completely different type of structure, including simply displaying the system on the ground or in a billboard application. In those instances support members 5 will take on a structure that is required to mount and securely hold the panel system in place, depending on the particular application at hand.

Regardless of the specific nature of support members 5, display panels 4 are rotationally secured to the support members to form a louver structure. In most instances the display panels will be mounted to the support members through the use of pivot pins 6. In the case of the embodiment shown in FIGS. 4 through 12 the pivot pins are mounted on the support members and engage the display panels in a manner that permits the display panels to rotate about a horizontal axis.

Figure 13:
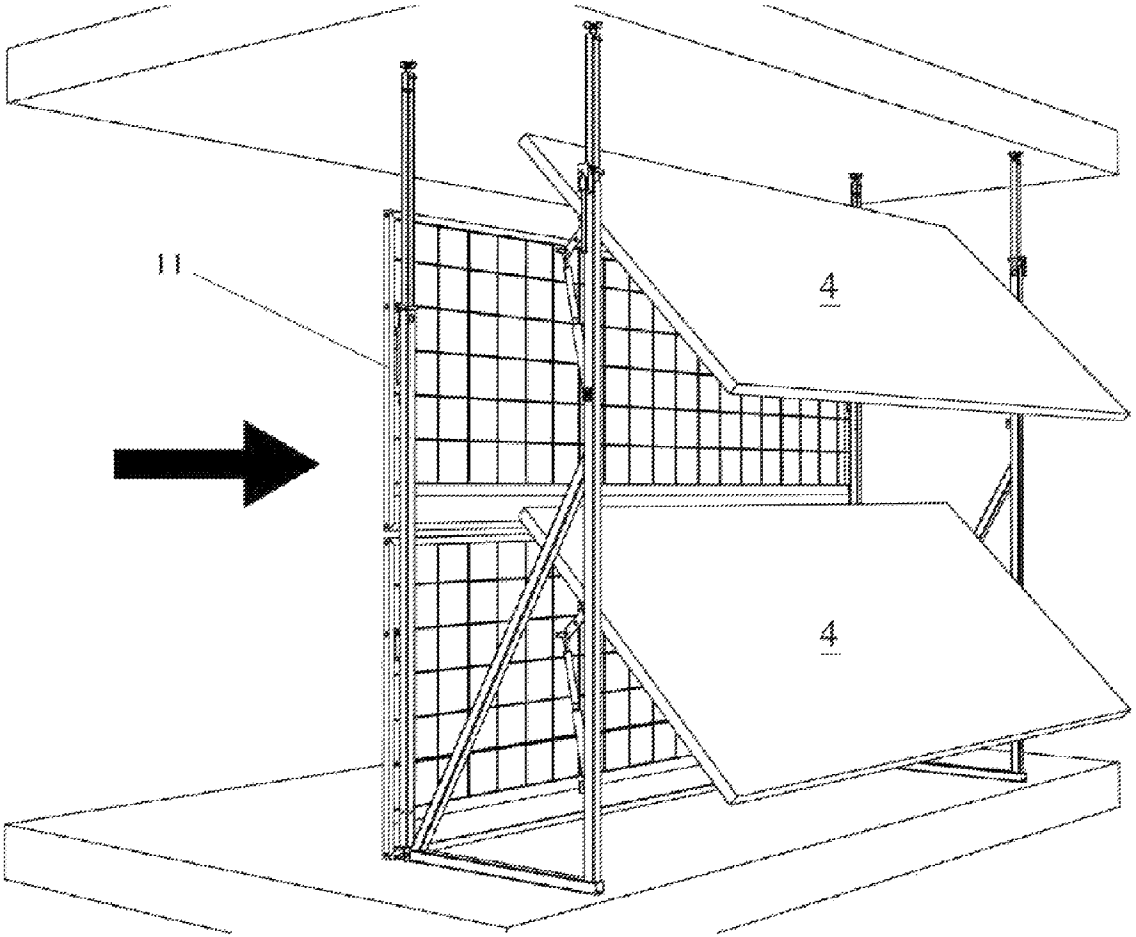
FIG. 13 is a side perspective view of the louver display panel system shown in FIG. 4 wherein the louvers are partially open upon the application of a rearward or tail wind.
Figure 14:
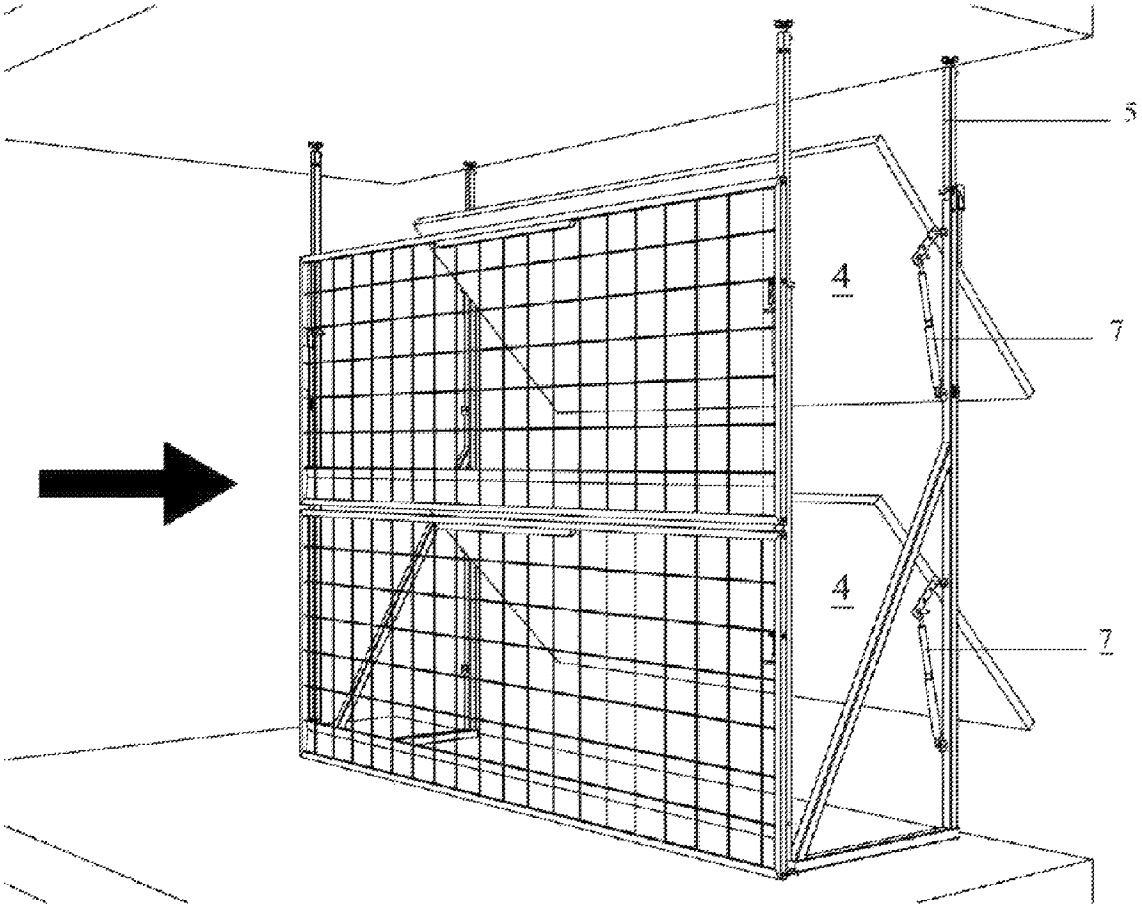
FIG. 14 is a rear perspective view of the louver display panel system shown in FIG. 13.

Louver display panel system 1 further includes at least one louver movement control means 7 that maintains the display panel or panels in a first position where they are situated in a plane that is generally parallel to the exterior surface or exterior face of the building or structure. Where the louver display panel system is mounted on the ground or is in the form of a billboard, the first position will generally be in an orientation that directs the exterior surface of the display panels in a fashion such that they can be readily viewed by the intended audience. Louver movement control means 7 is designed such that display panels 4 will be maintained in their first position until such time as either a forwardly directed (i.e. a head wind blowing against the outside surface of the building and as shown by the arrows in FIGS. 9 through 12) or a rearwardly directed (i.e. a tail wind blowing through the building and onto the backside of the display panels as shown by the arrows in FIGS. 13 through 15) wind load that is applied to the display panels exceeds a predetermined value. Once the wind load exceeds the predetermined value louver movement control means 7 will permit the display panels to at least partially rotate toward a second position that is generally parallel to the direction of the wind. FIGS. 12 and 15 demonstrate the movement of the display panel in that regard, with FIG. 12 showing movement that results from a forwardly directed or headwind and FIG. 15 showing movement that results from a rearwardly directed or tail wind. In both instances the display panel rotates about a horizontally oriented axis such that it "flattens" out (to at least some degree) thereby reducing the wind load that it bears. That is, as the force of the wind increases, louver movement control means 7 permits the display panel to rotate toward a position where it is increasingly co-planer with the direction of the wind to offer less wind resistance and to reduce the loading that is applied to the louver display panel system.

From a thorough understanding of the invention it will be appreciated that louver movement control means 7 can be designed to permit the louver to "open" at a desired wind speeds, and hence wind loading, depending upon the particular application at hand, the size of the display panel, the relative strength and anchoring force of the support members, and a host of other factors. In many instances it is expected that louver movement control means will allow the display panels to rotate to reduce wind loading beginning at a wind speed of approximately 50 km/h. As the wind speed slowly dissipates and the loading of display panel 4 decreases, louver movement control means 7 permits the panels to gradually move back to their first position and eventually to a point where they are once again generally parallel to the exterior face of the building or structure to which they are secured.

Figures 12A, 12B, 12C:
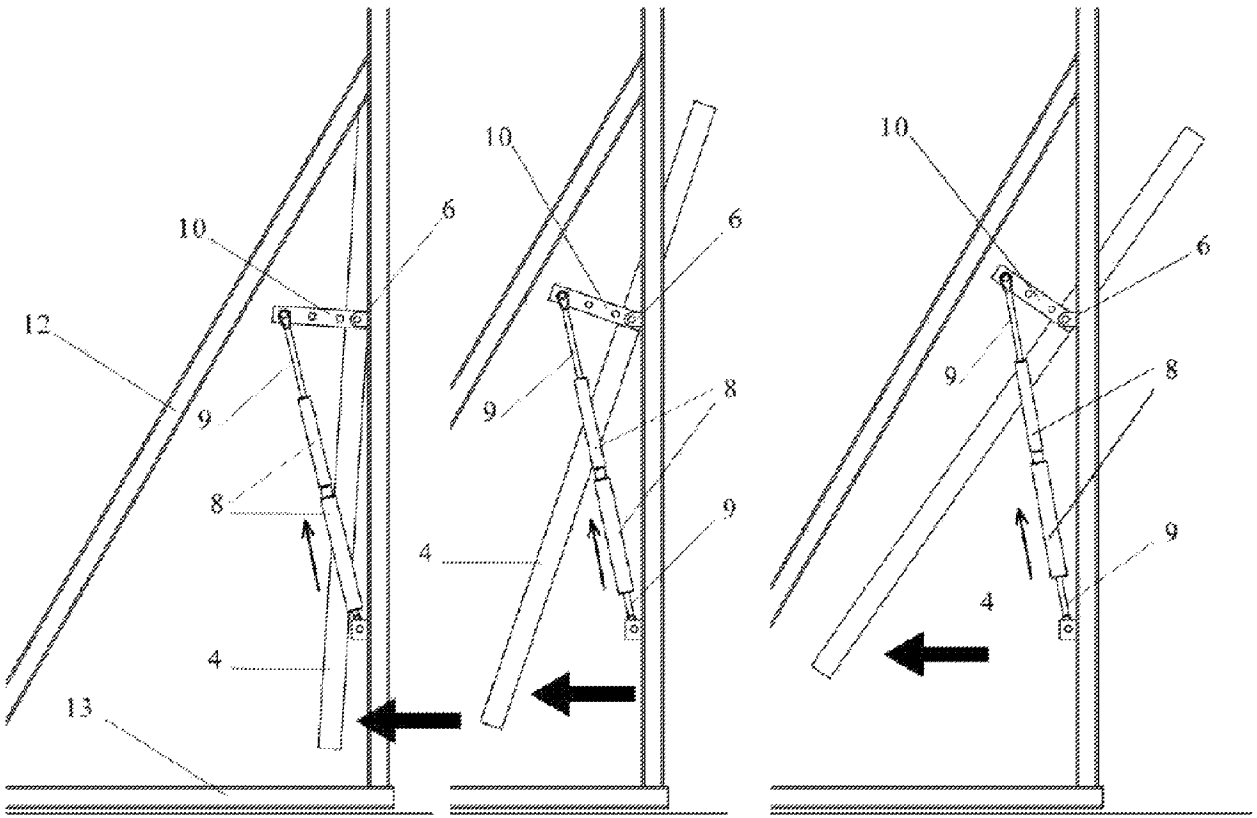
FIGS. 12A through 12C are side elevational views showing the movement of the louver and the progressive operation of the louver movement control means upon the application of a forward or head wind.
Figures 15A, 15B, 15C:
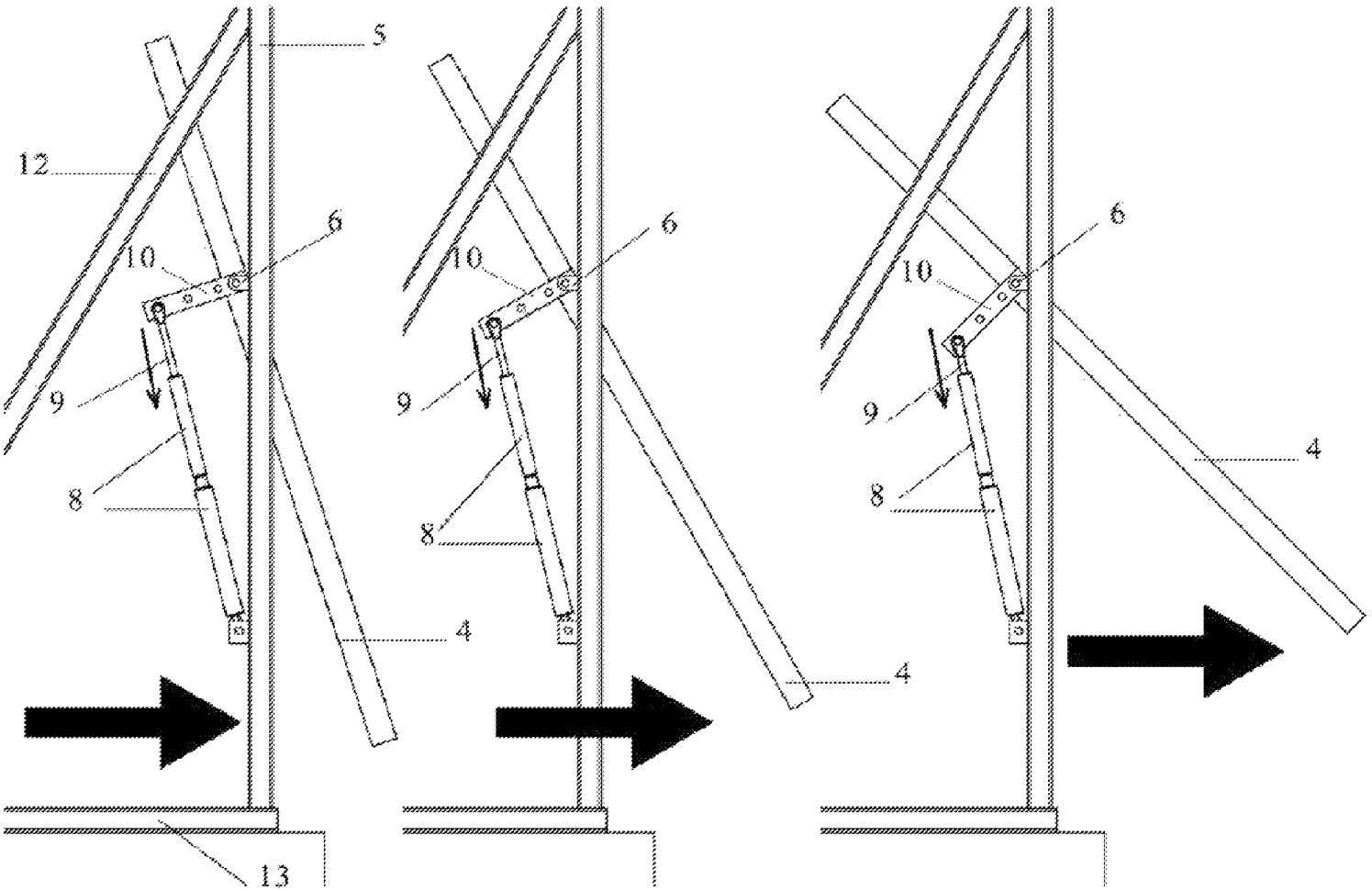
FIGS. 15A through 15C are side elevational views showing the movement of the louver and the progressive operation of the louver movement control means upon the application of a rearward or tail wind.

As mentioned, louver movement control means 7 permits the display panels to be rotated in two separate and opposite directions depending upon the direction of the wind. FIGS. 12A through 12C show the rotational movement of display panel 4 being in a generally clockwise direction when under the influence of a forwardly directed or head wind. FIGS. 15A through 15C represent the same embodiment of a louver wherein the louver rotates in a generally counter-clockwise direction on account of the application of a rearwardly directed or tail wind. It will be appreciated that the ability of the display panel to rotate in two opposite directions is largely a function of the fact that pivot pins 6 are off-set from the middle of the display panel, as shown in FIGS. 12 and 15. Through vertically off-setting the point that the pivot pins connect to the sides of the display panel there is effectively created a greater moment arm on the bottom of the display panel (in the embodiment shown) than at the top which causes a clockwise rotation to occur upon the application of a forwardly directed or head wind and a counter-clockwise rotation to occur upon the application of a rearwardly directed or tail wind. It will of course be appreciated that in an alternate embodiment of the invention the intersection of pivot pins 6 and display panel 4 could be such that the pivot pins are off-set toward the bottom of the display panel and that the direction of rotation on account of a head or tail wind can be reversed. As is discussed below, the display panels could in an alternate embodiment rotate about a generally vertical axis as opposed to a horizontal axis (see FIG. 16). In the situation where the panels are generally rectangular, when rotated about a generally vertical axis the panels will in most instances be oriented with their longitudinal axes in a generally vertical plane.

In one embodiment of the invention louver movement control means 7 comprises a double pneumatic or hydraulic piston. In an alternate embodiment (not shown) louver movement control means 7 could comprise one or more torsion and/or coil springs. It will further be appreciated that a number of more complex mechanisms could also be utilized for louver movement control means, including hydraulic cylinders, electrical solenoids, electric servo motors, etc. In the case of powered control means (for example, electric solenoids or servo motors) there could be included a wind speed monitor or load sensor on the display panels that could be used to activate the control means. In the case of the embodiment shown in FIGS. 7 and 8, louver movement control means 7 comprises a pair of pneumatic or hydraulic cylinders 8 mounted end to end with their pistons 9 extending in opposite directions. In this embodiment, one of the pistons is mounted to support member 5 whereas the other is mounted to a bracket 10 that is secured to the display panel at pivot pin 6. Bracket 10 extends outwardly from the surface of the display panel to permit the pneumatic or hydraulic cylinders to apply a torque to the panel when the cylinders are under operation in order to both resist rotational movement until such time as the wind load exceeds a predetermined value and also to move the display panel back to its first position where it is generally parallel to the exterior surface of the building when the wind drops below the predetermined value.

Louvre display panel system 1 may also include a rear guard or cage 11 that is set-off a distance from the rear surface of display panels 4. The guard or cage prevents access to the display panels and also serves to keep objects from contacting the display panels upon their rotation. As shown in the attached drawings, louver display panel system 1 may further include a brace member 12 positioned and connected between support members 5 and guard or cage 11. Since in most instances it is expected that the primary wind load will be a forwardly directed or head wind, brace member 12 will preferably be angled downwardly from the support member to the guard or cage to help distribute wind loading that is borne by the panels to both the support member and the guard or cage. As shown in the attached drawings, guard or cage 11 would typically be comprised of further support posts and fence panels, of the type commonly used for barrier systems or safety fencing. Louver display panel system 1 may further include a base support 13.

Figures 6A, 6B, 6C:
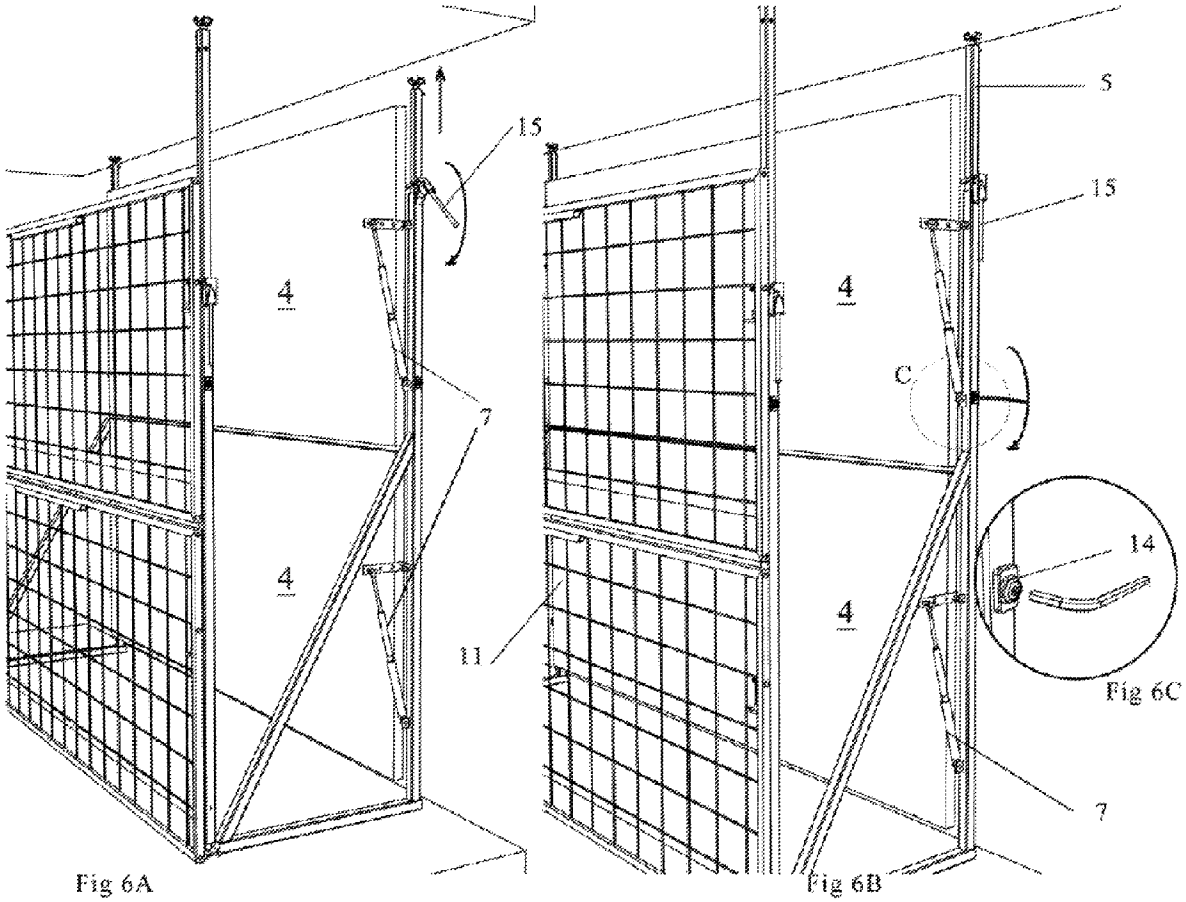
FIG. 6A is a side perspective view of the louver display system shown in FIG. 5 as its support posts are being secured in place.
FIG. 6B is a view similar to FIG. 6A showing the support post being locked in position.
FIG. 6C is an enlarged detail of portion C shown in FIG. 6B.
Figure 7:
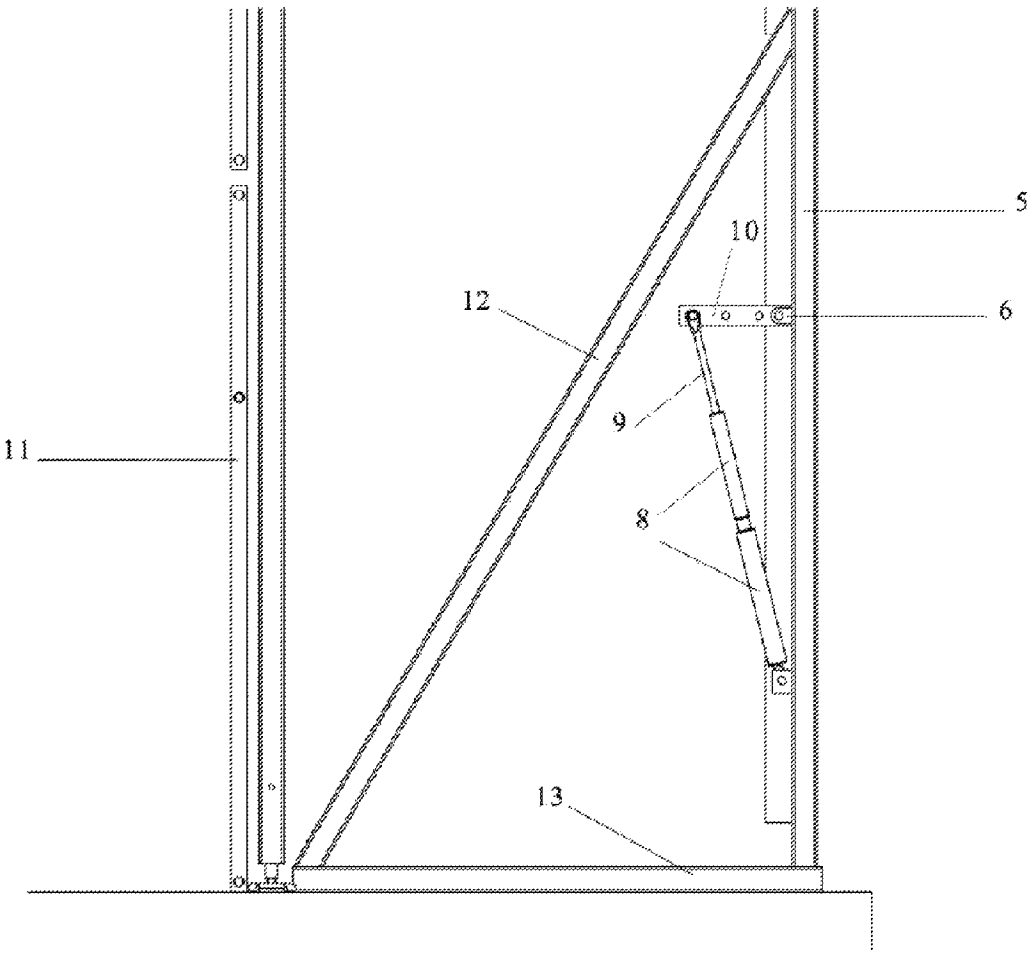
FIG. 7 is an enlarged side view of the lower portion of the louver display panel system shown in FIG. 4.
Figure 8:
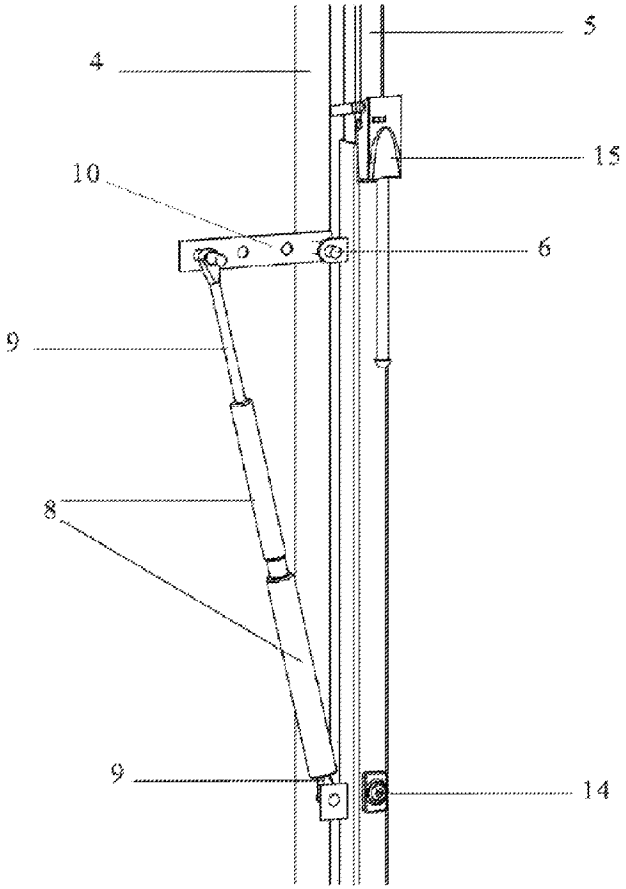
FIG. 8 is an enlarged side view of the louver movement control means of FIG. 4.
Figure 9:
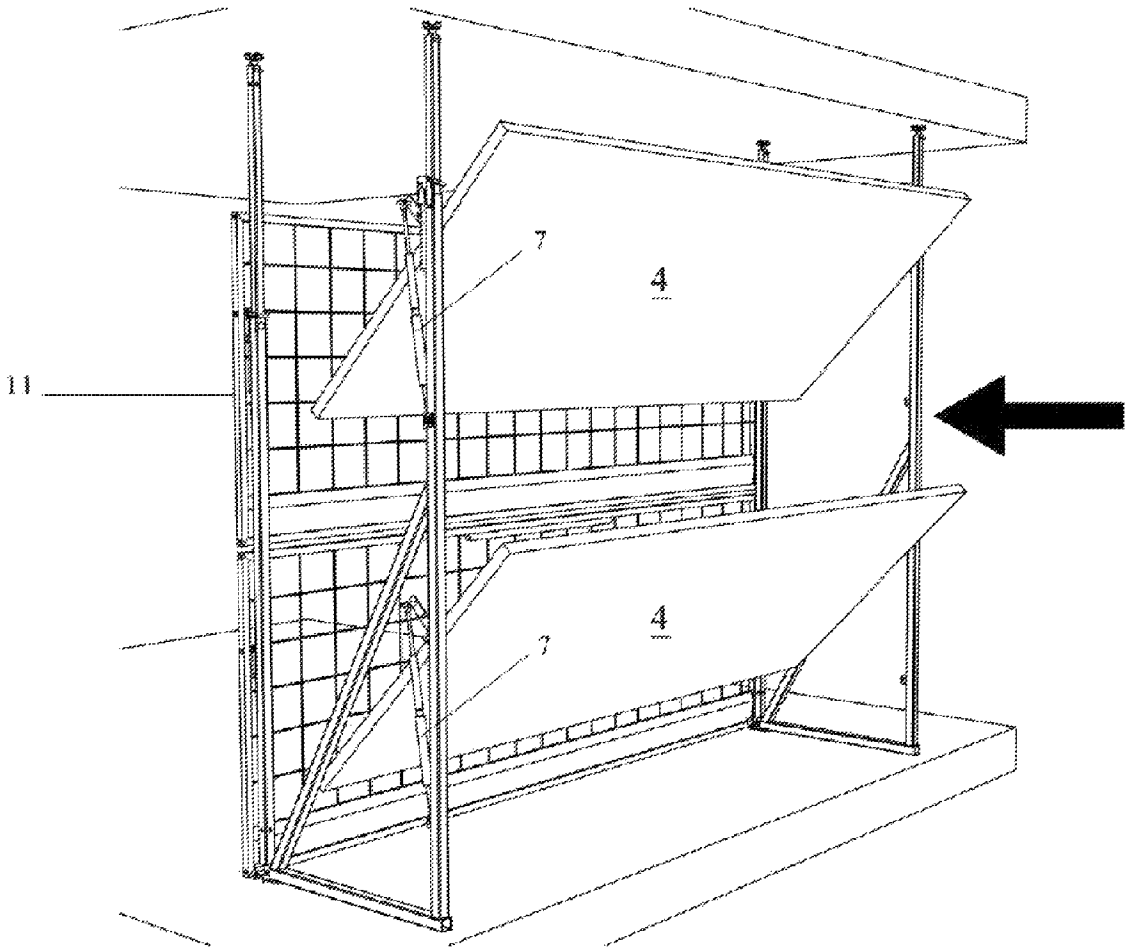
FIG. 9 is a side perspective view of the louver display panel system shown in FIG. 4 wherein the louvers are shown in a partially open configuration upon the application of a forward or head wind.
Figure 10:
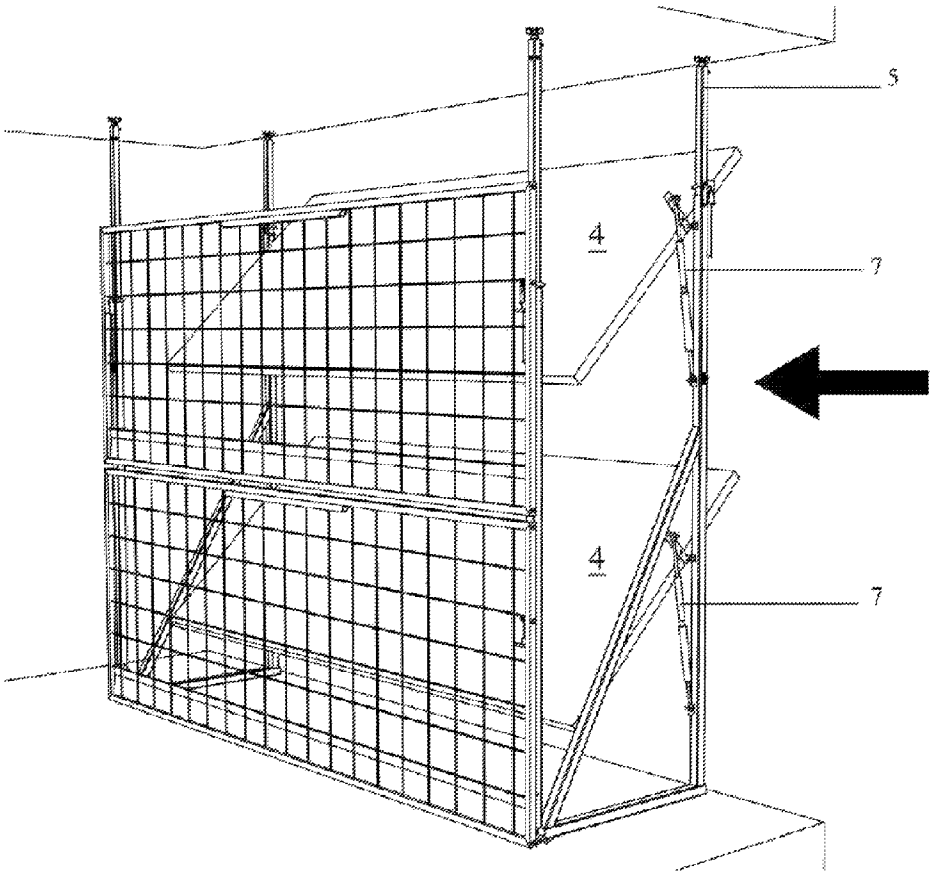
FIG. 10 is a rear perspective view of the louver display panel system shown in FIG. 9.
Figure 11:
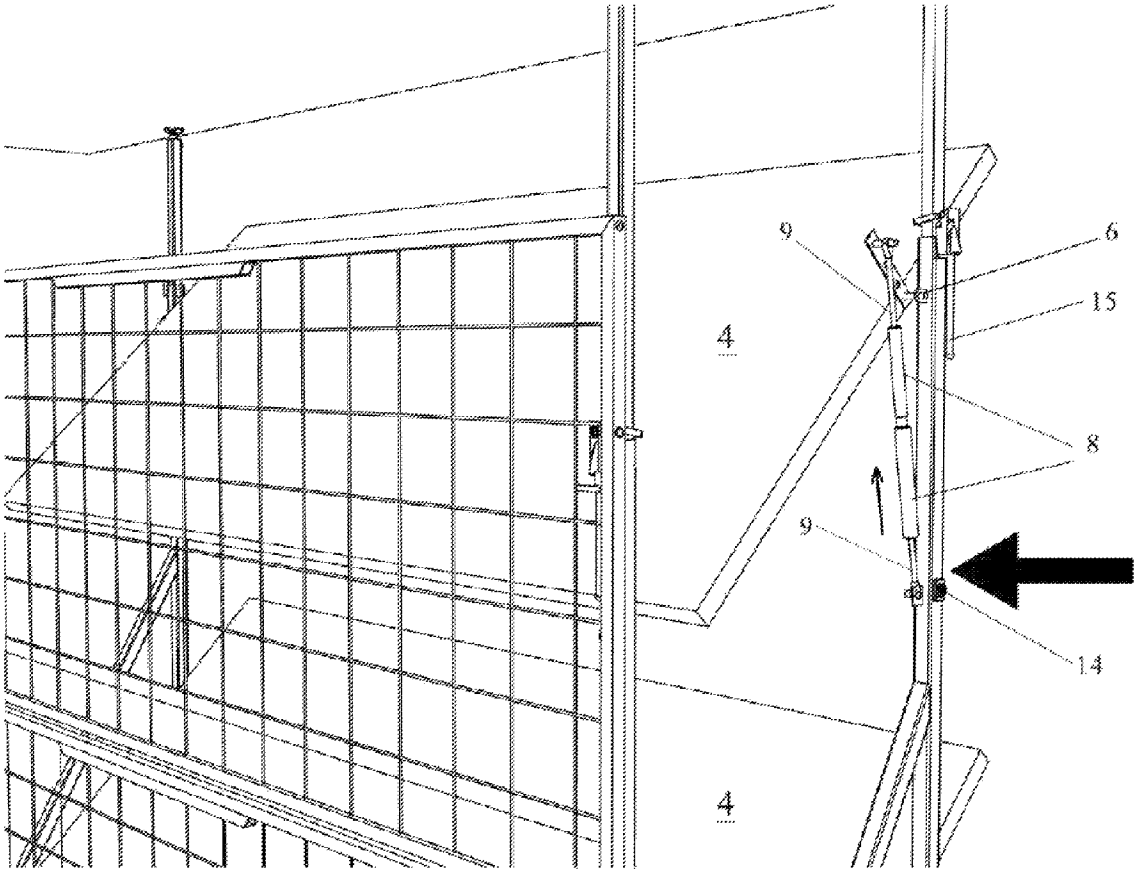
FIG. 11 is an enlarged rear perspective view of the louver display panel system shown in FIG. 10.

As shown more specifically in FIGS. 6B and 6C, to account for the high degree of wind loading that may be applied to display panels 4, support members 5 may be fitted with a secondary locking mechanism 14. The secondary lock would typically take the form of a threaded stud that would engage the inner tubular member where support member 5 is a telescopic support post. The threaded stud acts to secure the support post in place should for any reason the primary locking lever 15 of the support post fail or be unintentionally disengaged. FIG. 6C demonstrates the engagement of the threaded stud through the use of an allen wrench.

Figure 16:
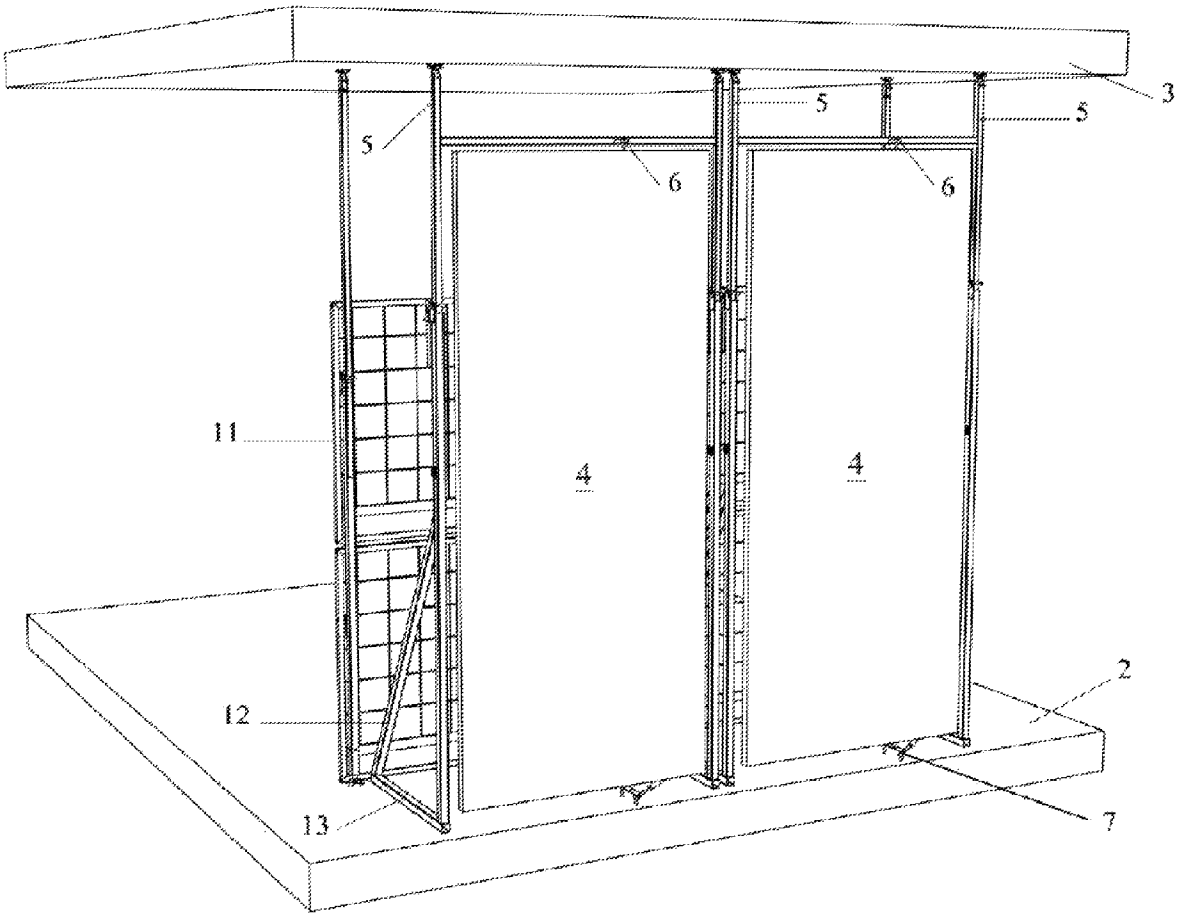
FIG. 16 is an alternate embodiment of the louver display panel system shown in FIG. 4.

FIG. 16 depicts an alternate embodiment of the invention wherein the display panels are oriented vertically such that they pivot about a vertically oriented axis. But for their vertical orientation, the display panels function in essentially the same manner as those shown in FIGS. 1 through 15.

It will thus be appreciated by one of ordinary skill in the art having a thorough understanding of the described invention that there is provided an effective means to display advertising or other graphic or printed material on a building or other structure while enabling the advertising to accommodate wind loading that may otherwise cause a destruction of the advertising medium or present safety concerns. The ability of the display panel to rotate in separate and opposite directions depending upon the direction of the wind load, allows the louver display panel system to function safely and efficiently regardless of the direction of the wind. The use of a dual acting pneumatic or hydraulic cylinder, or a pair of pneumatic or hydraulic cylinders mounted end to end with their pistons extending in opposite directions, permits a precise control over the rotation of the display panels in either direction. As the display panels are subjected to an increasing wind load in either a forward or a rearward direction the louver movement control means permits the display panels to rotate in one of their two directions and towards an orientation where they are somewhat parallel to the direction of the wind, thereby reducing the wind load that they must bear. As the wind speed increases so does the degree of rotation of the panels. Eventually, when the wind speed diminishes to a safe level the louver movement control means will rotate the panels back to their initial position where they are once again generally parallel to the exterior face or surface of the building or structure and oriented such that they direct the advertising or other printed or graphic material in a desired direction. The described louver display panel system further provides the ancillary benefit of adding a degree of protection to the interior of a building under construction from rain and snow. When the display panels are generally parallel to the exterior face of the building they will also, to a certain extent, shield the contents of the floor on which they are mounted, and workers on those floors, from light winds.

It will also be appreciated that that such a louver display panel system can be constructed to be lightweight and easily movable from place to place or, alternatively, could be permanently mounted to act as a permanent advertising medium.

Depending upon the particular application at hand, the construction of display panels 4 could vary widely. In some instances they could be a metal skinned slab, a foam core slab, or a frame covered with a durable flexible synthetic material.

It is to be understood that what has been described are the preferred embodiments of the invention. The scope of the claims should not be limited by the preferred embodiments set forth above, but should be given the broadest interpretation consistent with the description as a whole.

What is claimed is:

1. A louver display panel system comprising:

one or more display panels for receiving advertising or other printed or graphic material thereon;

one or more support members to secure said one or more display panels to a building or structure, said one or more display panels rotationally secured and mounted to said one or more support members and forming a louver structure;

at least one louver movement control means, said louver movement control means maintaining said one or more display panels in a first position where they are in a plane generally parallel to the exterior face of the building or structure until a forwardly or rearwardly directed wind load applied to said one or more display panels exceeds a pre-determined value, after which said louver movement control means permits said one or more display panels to at least partially rotate toward a second position that is generally parallel to the direction of the wind to reduce the wind load borne by said one or more display panels, said louver movement control means returning said one or more display panels to said first position when the wind load drops below said pre-determined value, said louver movement control means comprising a pair of pneumatic or hydraulic cylinders mounted end to end with their pistons extending in opposite directions.

2. The louver display panel system as claimed in claim 1, wherein said louver movement control means permits rotational movement of said one or more display panels in a first direction when said one or more display panels are exposed to a pre-determined forwardly directed wind load, said louver movement control means permitting rotational movement of said one of more display panels in a second opposite direction when said one or more display panels are exposed to a pre-determined rearwardly directed wind load.

3. The louver display panel system as claimed in claim 2, wherein said one or more support members comprise one or more support posts, said one or more display panels being generally rectangular and mounted to said support posts through the use of pivot pins that intersect said one or more display panels at a position off-set from their central axis.

4. The louver display panel system as claimed in claim 3, including a rear guard or cage that is set-off from said one or more display panels to prevent access to said one or more display panels and to keep objects from contacting said one or more display panels upon the rotation of said panels.

5. The louver display panel system as claimed in claim 4, including a brace member positioned between each of said posts and said guard or cage to distribute wind loading borne by said panels to both said posts and said guard or cage.

6. The louver display panel system as claimed in claim 5, wherein said posts are support posts for securing between the floor and ceiling structure of a multi-story building.

7. The louver display panel system as claimed in claim 1, having two display panels mounted on a pair of support posts.

8. The louver display panel system as claimed in claim 7, wherein said display panels are positioned with one panel vertically above the other and the axis of rotation of said panels is generally horizontal.

9. The louver display panel system as claimed in claim 1, wherein said display panels are positioned with their axes of rotation in a generally vertical plane.

10. The louver display panel system as claimed in claim 1, wherein one of said pistons is mounted to a support post and the other of said pistons is mounted to a bracket secured to said display panel.

11. A louver display panel system comprising:

a generally rectangular display panel rotationally secured and mounted to a pair of support posts that are releasably securable to a building or structure, said display panel forming a louver structure; and a pair of louver movement control means associated with said display panel, each of said control means comprising a pair of pneumatic or hydraulic cylinders mounted end to end with their pistons extending in opposite directions and having one piston secured to one of said support posts and the other of said pistons secured to a bracket secured to said display panel, said pneumatic or hydraulic cylinders maintaining said display panel in a plane that is generally parallel to the exterior face of the building or structure until either a forwardly or rearwardly directed wind load is applied to said panel that exceeds a pre-determined value, after which said pneumatic or hydraulic cylinders permit said display panel to rotate to thereby reduce the wind load borne by said display panel, said pneumatic or hydraulic cylinders returning said display panel to its position where it is generally parallel to the exterior face of the building or structure when said wind load drops below said pre-determined value.

12. A louver display panel system comprising:

a display panel rotationally secured and mounted to at least one support member, and at least one louver movement control means associated with said display panel, said control means comprising a pair of pneumatic or hydraulic cylinders mounted end to end with their pistons extending in opposite directions and having one piston secured to said at least one support member and the other of said pistons secured to said display panel, said pneumatic or hydraulic cylinders maintaining said display panel in a plane that is generally vertical until either a forwardly or rearwardly directed wind load is applied to said panel that exceeds a pre-determined value, after which said pneumatic or hydraulic cylinders permit said display panel to rotate about said at least one support member away from its generally vertical position to thereby reduce the wind load borne by said display panel, said pneumatic or hydraulic cylinders returning said display panel to its generally vertical position when said wind load drops below said pre-determined value.

* * * * *